US005769368A

United States Patent [19]

Busey

[11] Patent Number: 5,769,368

[45] Date of Patent: Jun. 23, 1998

[54] DROP CLOTH HOLDER AND DISPENSER

[76] Inventor: Herman E. Busey, 19140 Martinsburg Rd., Dickerson, Md. 20842

[21] Appl. No.: 642,924

[22] Filed: May 6, 1996

[51] Int. Cl.[6] ..... A47F 7/17

[52] U.S. Cl. ..... 248/125.7; 248/125.1; 248/157; 248/125.9; 118/504; 52/DIG. 12

[58] Field of Search ..... 248/125.7, 122.1, 248/124.1, 125.1, 125.8, 125.9, 371, 150, 157, 172, 173; 160/24, 66, 71; 118/504; 52/DIG. 12

[56] References Cited

U.S. PATENT DOCUMENTS

| | | | |
|---|---|---|---|
| 1,384,250 | 7/1921 | Froom . | |
| 1,891,629 | 12/1932 | Van Wagner | 242/129.6 |
| 2,453,863 | 11/1948 | Salisbury | 118/504 X |
| 2,765,999 | 10/1956 | Baker | 248/124 |
| 3,039,433 | 6/1962 | Kormuth | 118/505 |
| 3,669,392 | 6/1972 | Saunders | 248/121 |
| 3,952,758 | 4/1976 | Addison et al. . | |
| 4,068,673 | 1/1978 | Bernardi | 160/24 X |
| 4,258,654 | 3/1981 | Ivankovich | 118/504 |
| 4,325,323 | 4/1982 | Rioux | 118/504 |
| 4,461,441 | 7/1984 | Briggs | 248/100 |
| 4,856,740 | 8/1989 | MacLeod et al. | 248/97 |
| 4,932,391 | 6/1990 | Bierdeman | 126/30 |
| 5,002,082 | 3/1991 | Roder . | |
| 5,023,755 | 6/1991 | Rosenberg | 248/124.1 X |
| 5,117,906 | 6/1992 | Soat | 248/125.1 X |
| 5,340,187 | 8/1994 | Haddad, Jr. | 160/71 X |
| 5,579,797 | 12/1996 | Rogers . | |

FOREIGN PATENT DOCUMENTS

| | | | |
|---|---|---|---|
| 439894 | 6/1912 | France | 248/97 |

*Primary Examiner*—Robert W. Gibson, Jr.
*Assistant Examiner*—Stephen S. Wentsler
*Attorney, Agent, or Firm*—Howard L. Rose

[57] ABSTRACT

A drop cloth holder and dispenser has a spine secured to a stand and vertically movable relative thereto. The spine has a plurality of telescoping arms extending therefrom; the arms mounted such as to be rotatable to a position generally parallel to the spine. The spine can be rotated to a position parallel to the stand and is adapted to carry a roll of drop cloth material that can be extended to cover the arms and retracted into a roll. The arms may be tilted relative to the horizontal to permit the structure to fit into relatively small areas.

8 Claims, 2 Drawing Sheets

DROP CLOTH HOLDER AND DISPENSER

FIELD OF THE INVENTION

The present invention relates to drop cloths of the type often used in painting and more particularly to a drop cloth holder and dispenser that is adaptable to many different sizes and shapes of spaces and may be folded for transport.

BACKGROUND OF THE INVENTION

Drop cloths of many forms have been developed and employed over many years. The prior art, however, appears to be directed more towards work attached arrangements rather than stand alone and collapsible structures.

U.S. Pat. No. 1,891,629 discloses a holder of a paper roll for dispensing paper to be applied over physician examining tables.

OBJECTS OF THE INVENTION

It is an object of the present invention to provide a portable drop cloth holder and dispenser.

It is another object of the present invention to provide a drop cloth holder and dispenser that may be folded into a compact configuration for transport.

Yet another object of the present invention is to provide a drop cloth holder and dispenser that may be adapted to various sizes and shapes of spaces in which work is to be performed.

BRIEF DESCRIPTION OF THE PRESENT INVENTION

The present invention has a main post supported by retractable feet, a member having a spine and multiple telescoping arms extending thereon. The member may be slid up and down on the post, the arms being foldable against the spine from which the arms extend. The spine may be rotated to be parallel to the post for transport and which in the operative position the entire spine and arm structure although normally in the horizontal position, may be rotated upwardly to reduce the distance from the post to the distal end of the arms. The spine has recesses at the extreme ends for holding a roll of drop cloth material that may be extended over the arms to provide the desired protection of the surface beneath the drop cloth.

The above and other features, objects and advantages of the present invention, together with the best means contemplated by the inventor thereof for carrying out the invention will become more apparent from reading the following description of a preferred embodiment and perusing the associated drawings in which:

DETAILED DESCRIPTION OF THE PRESENT INVENTION

Figure 1:
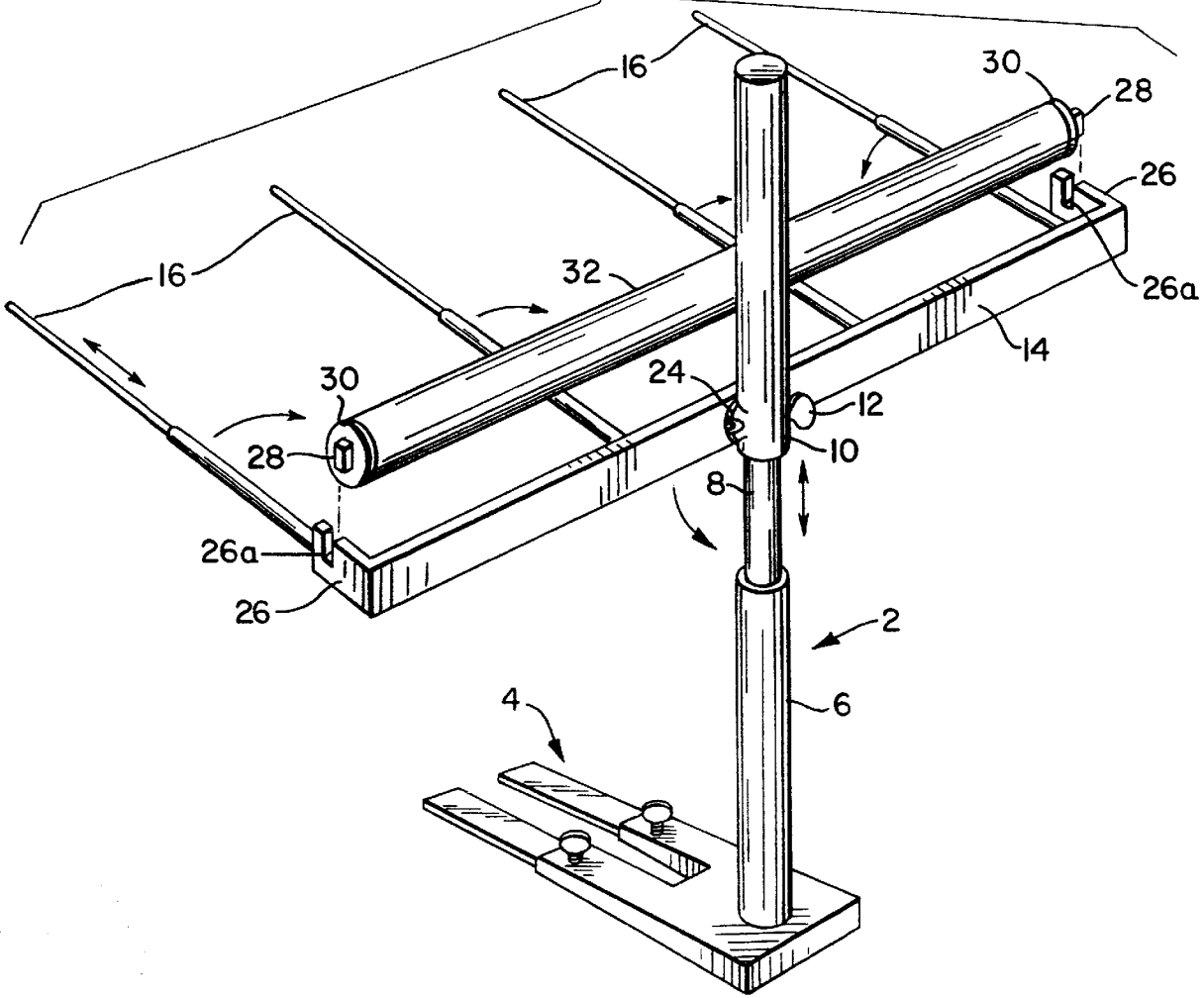
FIG. 1 is a vertical perspective view of one embodiment of the drop cloth structure of the present invention.

Referring now to FIG. 1 of the accompanying drawings, a post 2 is supported by feet 4. The feet have telescoping sections to permit the feet to be made smaller in tight spaces. The post 2 has a lower cylindrical section 6 with a cylindrical section 8 of reduced diameter extending upwardly therefrom. A hollow cylindrical post 10 of a slightly larger internal diameter than the diameter of the section 8 and an external diameter approximately equal to the diameter of section 6 is slidable on the section 8 of the post 2. The post 10 may be secured at any vertical height along section 8 by thumb screw 12. With the thumb screw 12 loosened the spine 14 may rotate about the section 8 as indicated by the curved arrow.

A spine 14 is secured to the post 10 and supports, for example, four telescoping arms 16. The number of sections and length of the arms 16 will be determined by the environment in which the structure is to be used. Arms of a length of four feet are common on a spine of four feet wide.

Figure 2:
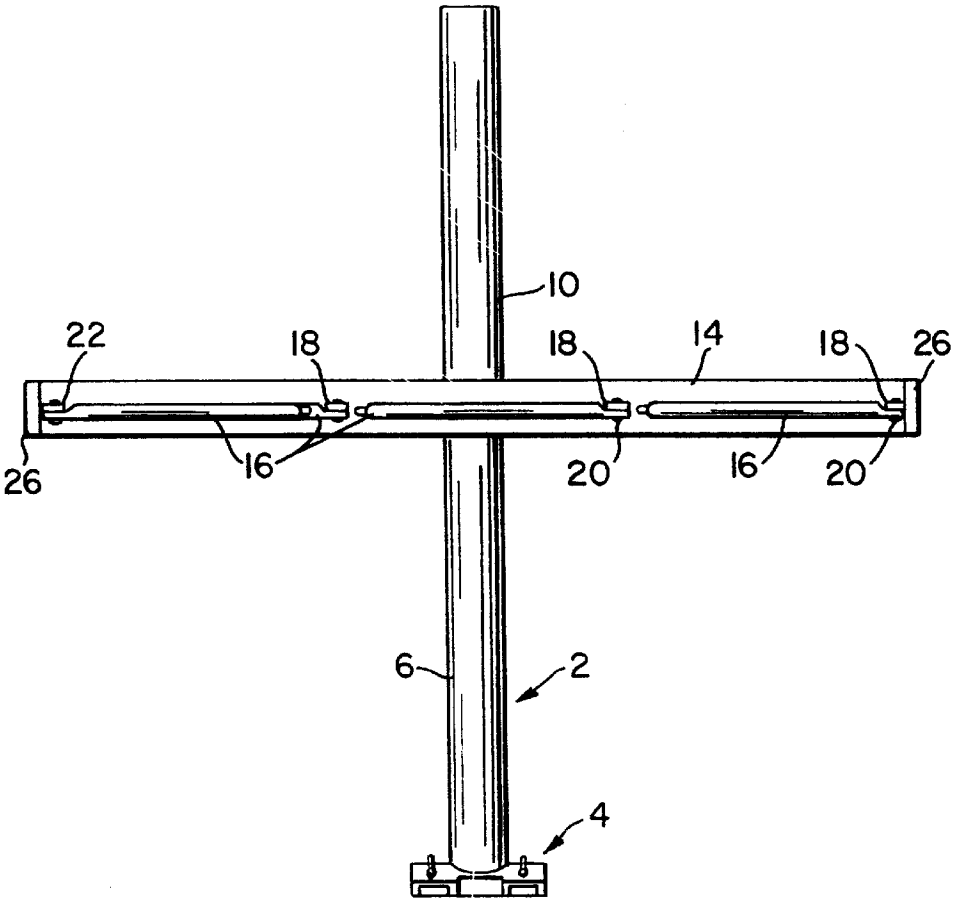
FIG. 2 is a detailed view of the spine with the arms that support the drop cloth in the folded position.

As more clearly illustrated in FIG. 2, the arms may be pivotally mounted on the spine by a projection 18 secured to the spine in conjunction with a pivot 20 extending through the projection 18 and the base of the arm 16. The telescoping sections of the arms may be such as to permit when the arms are fully contracted to fold against the spine between adjacent arms. In the form illustrated the left three arms are folded to the right while the right arm is folded to the left from a projection 22 that extends out from the spine a sufficient distance for the right arm to overlie the arm or arms to its left as illustrated in the figure.

Figure 3:
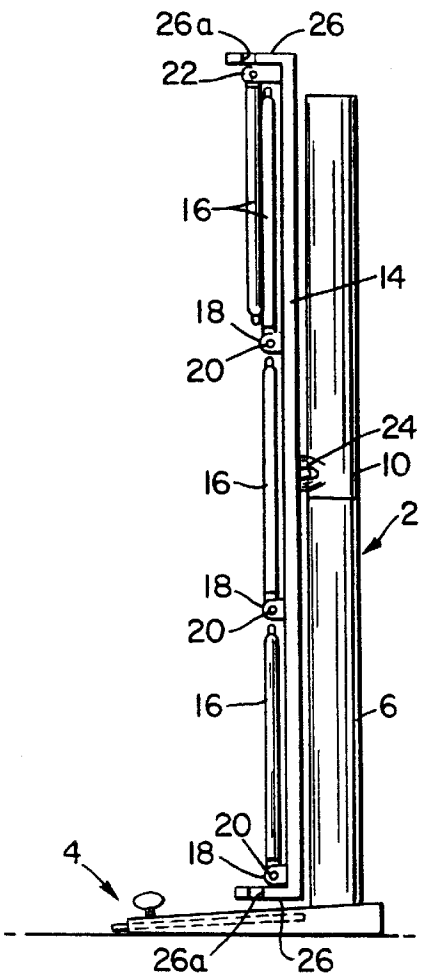
FIG. 3 is a view of the spine and folded arms rotated into the vertical position for transport.

Referring to FIG. 3 a joint 24 positioned between the spine 14 and post 10 permits the spine to be rotated into a vertical position so that it is parallel to the post 6-8-10 for transport. When the structure is to be transported the leg 4 is telescoped to its minimum extension. All rotation joints may employ ball and spring detenting to insure position is maintained.

The spine 14 has at each side forward projection 26 with notches 26*a* in its top surface to receive end members 28 of a window blind like roller 30. Mounted on the roller 30 is a drop cloth 32 that when the members 28 are seated in notches 26*a* may be extended to cover the arms 16 thus providing drop cloth protection. The roller, like a window blind roller employs a spring to roll up the drop cloth when it is released.

Figure 4:
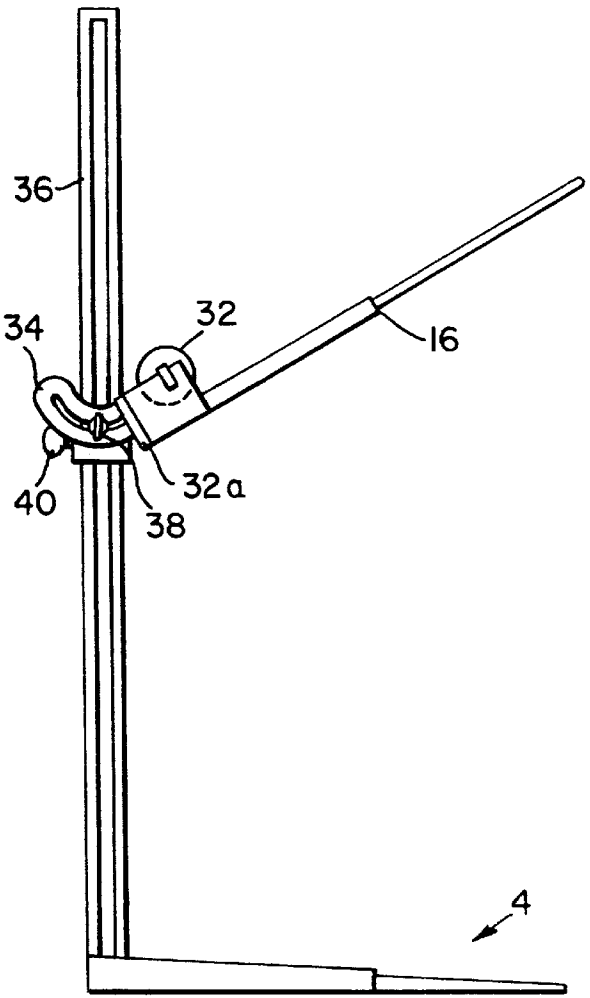
FIG. 4 is a side view of the second embodiment of the invention with the arms in a partially raised position.

Referring specifically to FIG. 4 of the accompanying drawings, there is illustrated a second embodiment of the present invention. In this embodiment the spine and arms may be tilted above the horizontal to accommodate an area in which the painter is operating. Spine 32*a* has a pair of slotted, upper arcuate projections 34, one on each side of a pole 36, and extending in a direction opposite the direction of arms 16. If the painter is operating in an area that cannot accommodate even the telescoping arms in the retracted position, the spine and arms may be raised as seen in FIG. 4. Thumb screws 38 (only one illustrated)secures the spine and arms in the position illustrated in FIG. 4 while thumb screw 40 retains the spine and arms at a desired height along pole 36.

Once given the above disclosure, many other features, modifications and improvements will become apparent to the skilled artisan. Such features, modifications and improvements are, therefore, considered to be a part of this invention, the scope of which is to be determined by the following claims.

What is claimed is:

1. A drop cloth holder and dispenser comprising a stand having a base and a single vertical pole structure extending upwardly from said base, said vertical pole structure having a vertical axis, an elongated spine having two ends secured to said vertical pole structure and having a plurality of arms extending from said spine, said spine and arms adjustable in height along and rotatable about a horizontal axis relative to said vertical pole structure, a roll of material secured to a roller and extendable over and retractable from said arms, said spine having notches adjacent its two ends, and said roller having end members seatable in said notches.

2. A drop cloth holder and dispenser according to claim 1 wherein said spine is adjustable in height relative to said base.

3. A drop cloth holder and dispenser according to claim 1 wherein said arms have telescoping members whereby the length of said arms is adjustable.

4. A drop cloth holder and dispenser according to claim 3 wherein said telescoping members may be adjusted to provide a length of arms less than the spacing between said arms along said spine.

5. A drop cloth holder and dispenser according to claim 1 wherein said spine has an axis and the spine may be rotated such that the axis of the spine is perpendicular to and parallel to said vertical axis of said vertical pole structure, alternatively.

6. A drop cloth holder and dispenser according to claim 1 wherein said arms are rotatable relative to said spine whereby they may be perpendicular to and parallel to said spine, alternatively.

7. A drop cloth holder and dispenser according to claim 1 further comprising means for rotating said spine to change the angle of said arms relative to said base.

8. A drop cloth holder and dispenser according to claim 1, further comprising:

means for mounting said spine on said vertical pole structure to permit rotation of said spine about said vertical axis of said vertical pole structure.

* * * * *